US007143564B2

(12) United States Patent
Renck

(10) Patent No.: US 7,143,564 B2
(45) Date of Patent: Dec. 5, 2006

(54) REINFORCED FIBER PANEL AND METHOD OF FORMING SAME

(75) Inventor: Lawrence E. Renck, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 259 days.

(21) Appl. No.: 10/716,775

(22) Filed: Nov. 19, 2003

(65) Prior Publication Data

US 2005/0102970 A1 May 19, 2005

(51) Int. Cl.
*E04C 2/32* (2006.01)
*E04C 2/54* (2006.01)

(52) U.S. Cl. ..... 52/783.17; 52/783.11; 52/783.19; 52/790.1; 52/800.1; 52/745.05; 52/745.13

(58) Field of Classification Search ..... 52/606, 52/618, 630, 707, 787.1, 783.17, 783.19, 52/793.1, 794.1, 783.1, 783.11, 784.14, 783.18, 52/790.1, 798.1, 800.1, 745.05, 745.13; 428/117, 428/118

See application file for complete search history.

(56) References Cited

U.S. PATENT DOCUMENTS

| | | | | |
|---|---|---|---|---|
| 1,875,188 | A | 8/1932 | Williams | |
| 3,533,894 | A | 10/1970 | Engelbrecht et al. | |
| 3,557,512 | A | 1/1971 | Braeuninger et al. | |
| 3,709,161 | A * | 1/1973 | Kauffman | 108/57.34 |
| 4,076,877 | A * | 2/1978 | Tanzen | 428/73 |
| 4,702,870 | A | 10/1987 | Setterholm et al. | |
| 4,884,631 | A * | 12/1989 | Rippel | 165/185 |
| 5,116,689 | A | 5/1992 | Castro et al. | |
| 5,177,924 | A * | 1/1993 | Kakuk | 52/606 |
| 5,269,219 | A | 12/1993 | Juvik-Woods | |
| 5,407,727 | A * | 4/1995 | Newell | 428/188 |
| 5,568,774 | A | 10/1996 | Hutchison | |
| 5,876,831 | A * | 3/1999 | Rawal | 428/117 |
| 5,900,304 | A | 5/1999 | Owens | |
| 5,909,712 | A | 6/1999 | Tan | |
| 6,041,719 | A | 3/2000 | Vidal et al. | |
| 6,497,082 | B1 * | 12/2002 | Toyoda et al. | 52/787.1 |
| 2002/0014051 | A1 | 2/2002 | Fraval et al. | |

FOREIGN PATENT DOCUMENTS

| | | |
|---|---|---|
| CA | 2 350 688 A1 | 12/2002 |
| FR | 1 431 299 | 3/1966 |
| GB | 794217 | 4/1958 |

OTHER PUBLICATIONS

The European Search Report for European Application No. 04256949.1; filed Nov. 10, 2004; Date of Completion Dec. 28, 2004.

* cited by examiner

*Primary Examiner*—N. Slack
*Assistant Examiner*—Yvonne M. Horton
(74) *Attorney, Agent, or Firm*—Alston & Bird LLP

(57) ABSTRACT

The present invention is directed to a reinforced panel that includes a face sheet having an interior side and an exterior side, a plurality of integral and intersecting ribs having distal ends and projecting from the interior side of the face sheet to form contiguous cells, and a reinforcing member positioned in a channel and secured thereto for increasing bending resistance of the panel.

31 Claims, 11 Drawing Sheets

REINFORCED FIBER PANEL AND METHOD OF FORMING SAME

BACKGROUND OF THE INVENTION

The present invention relates to three-dimensional structural products, and more particularly to structural products made from wood products and methods of forming same.

Structural panels can be used in a variety of applications, including applications similar to those in which plywood or lumber conventionally are used. For instance, structural panels can be used in the construction of pallets. Pallets and similar support devices are common articles that are used to transport goods in a variety of industries. Pallets can come in many shapes and sizes, and are typically formed from wood planks or molded plastic. While these types of pallets are commonplace, they suffer from several disadvantages. First, pallets formed from wood planks require first quality pieces that are free from serious defects that could compromise the integrity of the pallet. Not only does obtaining quality wood add to the cost of the pallet, a significant portion of the supply trees are wasted during production. In addition, the wood planks forming the pallet are typically nailed together. The nailed joints may be sturdy at first, but they tend to fail due to the rigors of transporting goods. In fact, normal use typically destroys most pallets after an alarmingly low number of uses, as weather, product weight, and mishandling all play a role in their demise. Instead of repairing broken pallets, however, most users simply throw the pallets away, which creates further waste and increases the costs of transporting goods.

Molded plastic panels are also disadvantageous, in that they are constructed of non-natural materials that do not break down after the panels have been discarded. Plastic panels also tend to have low bending resistance, which limits the applications suitable for plastic panels.

Structural panels have been developed that address some of the shortcomings of wood plank and plastic panels. For example, U.S. Pat. No. 4,702,870 to Setterholm et al., the disclosure of which is incorporated herein by reference, discloses molded panels made of wood fiber from hardwood trees that are relatively small, deformed or otherwise not well shaped to produce commercial sizes and quantities of lumber, and limbs of larger hardwood trees that are not utilizable for lumber. Setterholm's panels utilize wood fibers that are processed into a slurry and then deposited on top of a mold. A normal force is applied to the slurry in conjunction with heat and vacuum to form the panel structure. One advantage of the Setterholm panels is that many different types of wood fibers, including soft wood fibers and hardwood fibers, can be used in the invention to more efficiently utilize the wood resources currently available.

Unfortunately, the inventors of the present invention have discovered that panels created by the teachings of Setterholm and/or similar techniques are susceptible to significant deformation when placed under load. This deformation can lead to immediate failure of the panel or greatly reduce the fatigue lifespan of the panel. Because of the nature of the materials forming the panel, there is a need to improve the bending resistance of such panels. There is also a need for forming a panel that has improved structural properties, yet that remains low in cost and can be produced efficiently.

BRIEF SUMMARY OF THE INVENTION

These and other needs are provided by the present invention that describes a reinforced product, such as a pallet, made from panels comprising fibrous materials, such as paperboard. Advantageously, the panel is structurally reinforced for greater strength by providing a channel and reinforcing member along at least a portion thereof. The reinforcing member is fitted into the channel and bonded therein to enhance the bending stiffness of the panel. The reinforcing member preferably comprises a paperboard lamination formed from multiple plies of paperboard or papermaking fibers adhered together and then folded to form the desired cross-sectional shape. The plies of the reinforcing member preferably are dry-bonded to each other using an adhesive, such as a modified silicate adhesive. Such a dry-bonding process adds little or no moisture to the structure. In one aspect of the invention, the panel is reinforced by being bonded to another panel, which may or may not have a reinforcing member of its own.

In particular, one embodiment of the invention includes a reinforced panel for supporting objects that includes a face sheet having an interior side and an exterior side, and a plurality of integral and intersecting ribs having distal ends and projecting from the interior side of the face sheet to form contiguous cells. The ribs define at least one channel extending across a plurality of the contiguous cells, and the channel may have one of many shapes. The contiguous cells may also have various cross-sectional shapes, such as round, elliptical, oval, and polygonal. A planar sheet may or may not be attached to the distal ends of the intersecting ribs.

A reinforcing member is positioned in the channel and bonded thereto for increasing the bending resistance of the panel. The reinforcing member can be of various shapes and sizes, including polygonal, circular, oval, and elliptical. In addition, the reinforcing member can have a cross-sectional shape, such as T-shaped, I-shaped, V-shaped, |-shaped and L-shaped. In one embodiment, the reinforcing member has a top end that is flush with the distal ends of the ribs, but in another embodiment the reinforcing member extends beyond the distal ends of the ribs.

In another embodiment of the present invention, a reinforced panel is provided that includes a first face sheet and a second face sheet, each having an interior side and an exterior side and a plurality of integral and intersecting ribs having distal ends and forming contiguous cells. At least one of the ribs of the first and second face sheets defines at least one channel extending across a plurality of the contiguous cells. A reinforcing member is positioned in the channel and secured thereto. In one embodiment, each face sheet defines a channel therein, although it is possible that only one face sheet defines a channel. If more than one channel is defined by the panel, one or more reinforcing members may be present that can extend from one face sheet to another, or it is possible that each face sheet has a reinforcing member such that the reinforcing members are adjacent one another. The reinforcing member can be made from paperboard, wood, metal, plastic, and combinations thereof.

In yet another embodiment, the face sheet is arranged such that the exterior side of the face sheet defines a channel, such as by folding one end of the panel on itself to form the channel. A reinforcing member is positioned in the channel in order to increase the bending resistance of the panel. In one such arrangement, the panel includes two face sheets, each having a plurality of integral and intersecting ribs, and wherein the face sheets are arranged so that the ribs of each face sheet are proximate the ribs of the other sheet. In all of the above embodiments, the panel is of superior strength and durability, which improves the lifespan and reduces costs of operation.

Methods are also provided by the present invention. In particular, one method of the present invention includes forming a reinforced panel for supporting objects including the steps of forming a first face sheet having a plurality of integral ribs extending therefrom, whereby the ribs have distal ends and form contiguous cells. A first channel is formed in the first face sheet that extends across a plurality of the contiguous cells, and a first reinforcing member is secured in the first channel for increasing the bending resistance of the panel. In one embodiment, the channel forming step and the face sheet forming step occur concurrently, such as by pressing and heating a slurry of paperboard material in a mold so that the channel is formed during the creation of the face sheet. Alternatively, the channel may be cut into the first face sheet after the face sheet has been formed. The first reinforcing member may be secured in the channel such that the reinforcing member is flush with the distal ends of the integral ribs, although it is possible that the reinforcing member may be secured in the channel so that a portion of the reinforcing member extends beyond the distal ends of the integral ribs. In another embodiment, the method further includes forming a second face sheet having a plurality of integral ribs, and forming a second channel that extends across a plurality of the cells defined by the ribs. A second reinforcing member may also be provided, and the second reinforcing member, the first reinforcing member, or both, are attached to the second channel. The first face sheet and the second face sheet are also attached to one another in order to provide a panel having increased bending resistance.

Accordingly, the panel and methods of forming a panel according to the present invention provide a structure having superior bending resistance over conventional paperboard or wood based structures. In addition, the panel of the present invention overcomes the disadvantages of wood plank and plastic panels and the like. Advantageously, the structures and methods afforded by the present invention are low cost, highly efficient, and safe.

BRIEF DESCRIPTION OF THE SEVERAL VIEWS OF THE DRAWINGS

Figure 1:
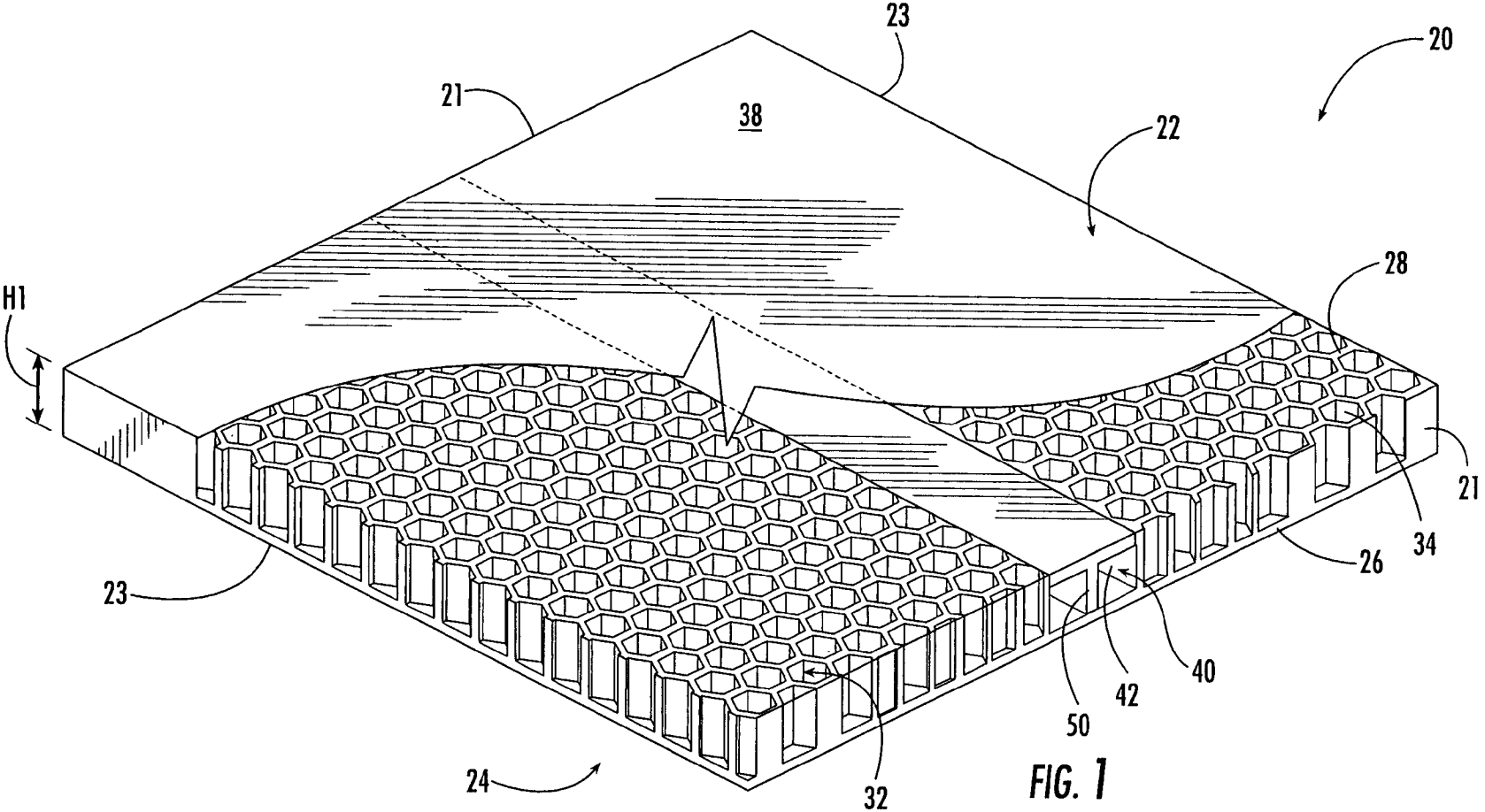
Figure 2A:
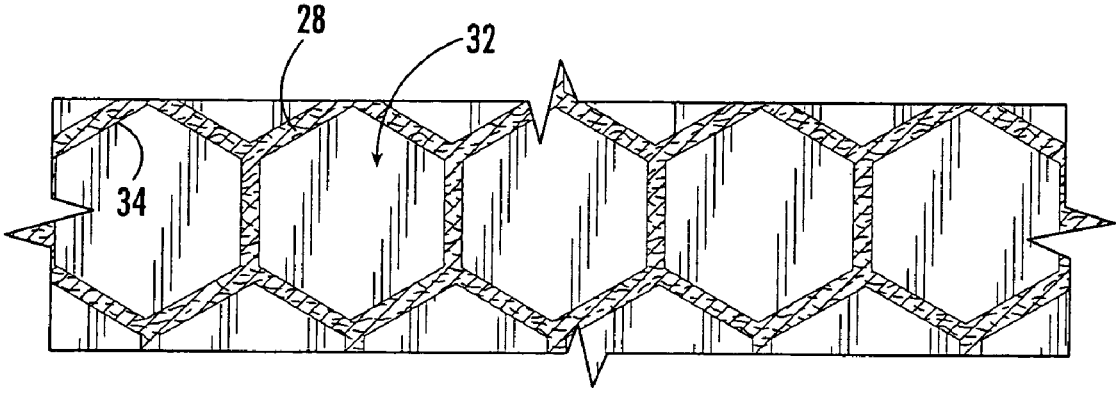
Figure 2B:
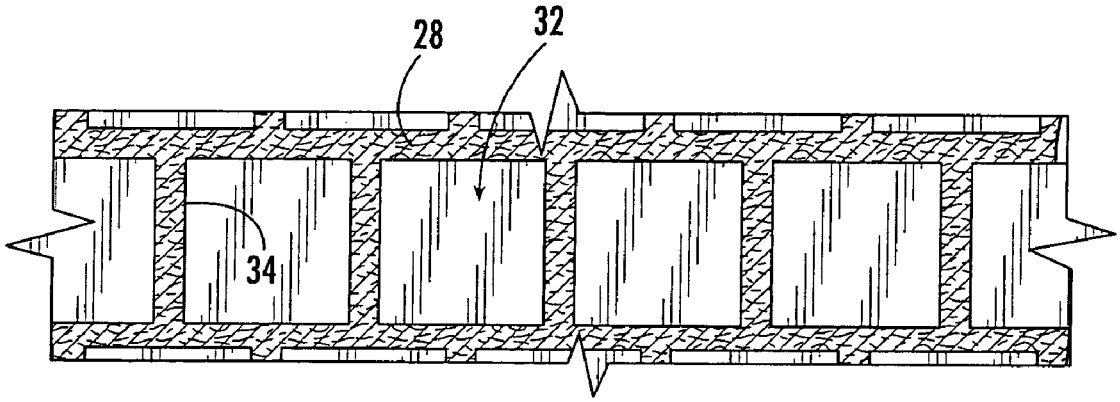
Figure 2C:
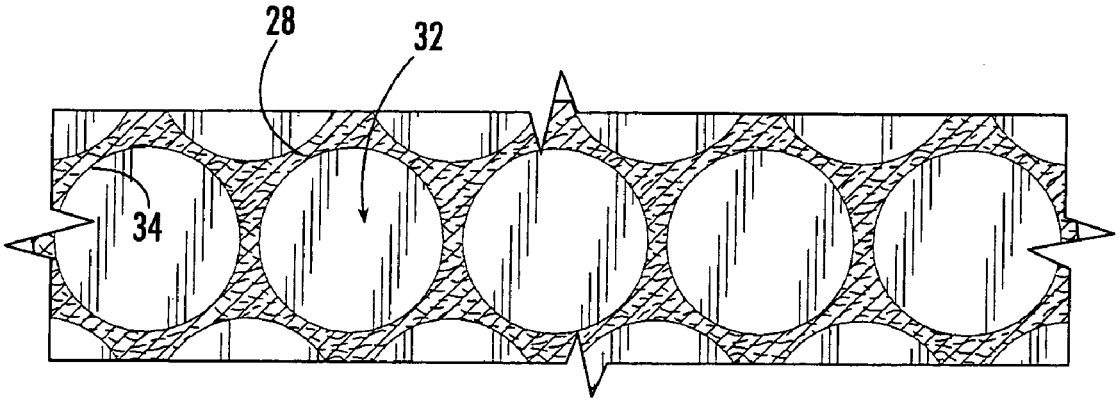
Figure 4:
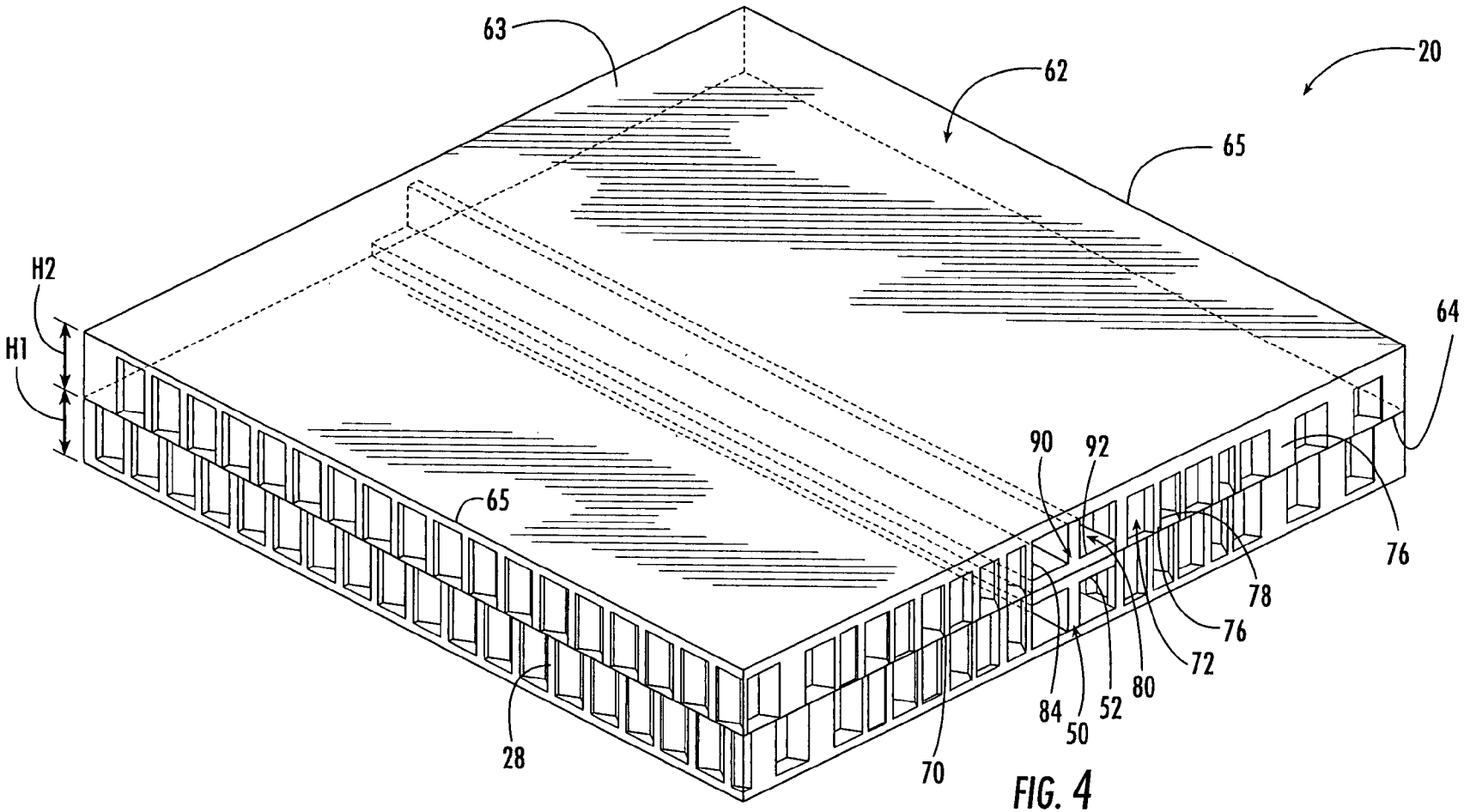
Figure 5:
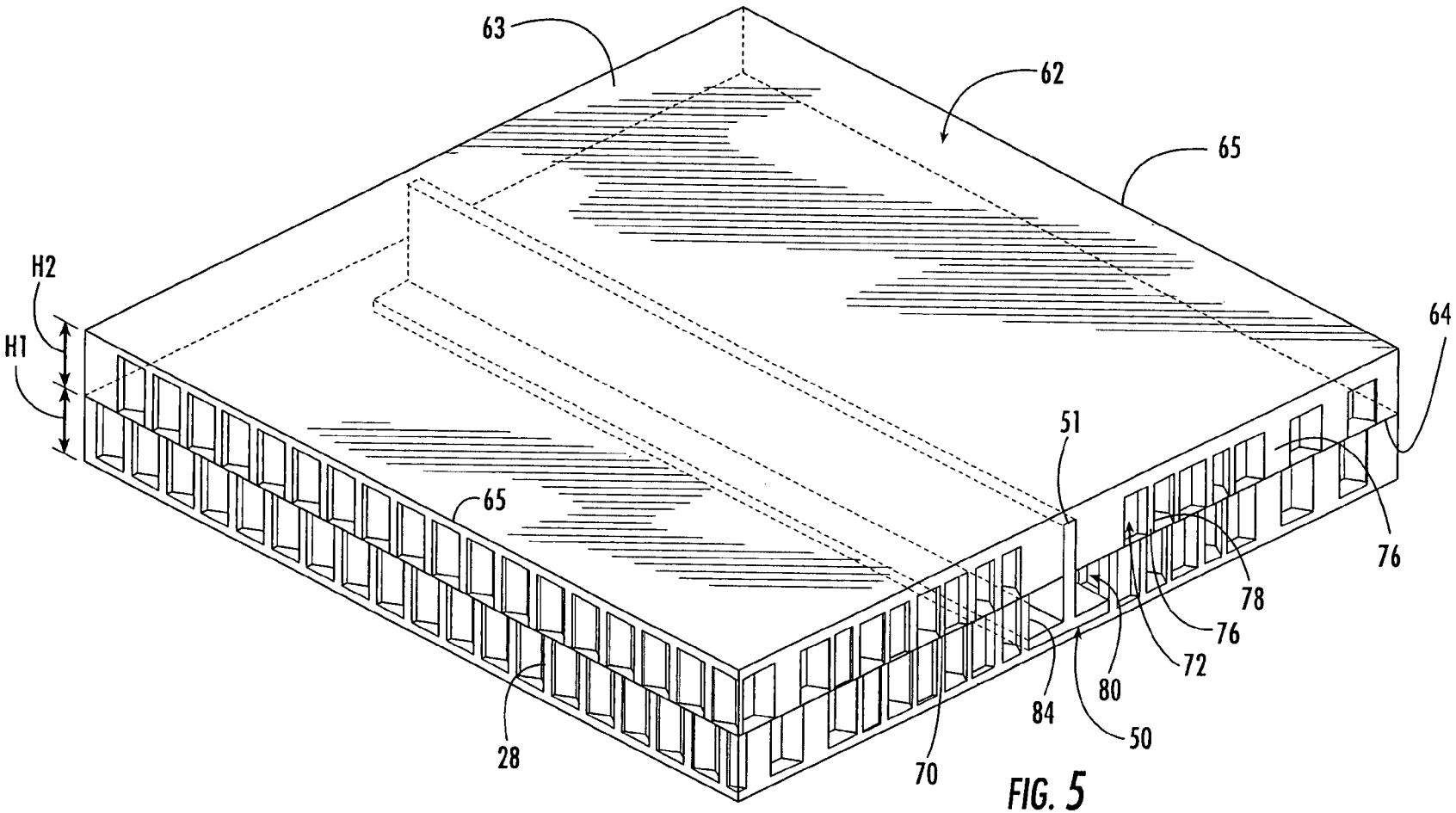
Figure 6:
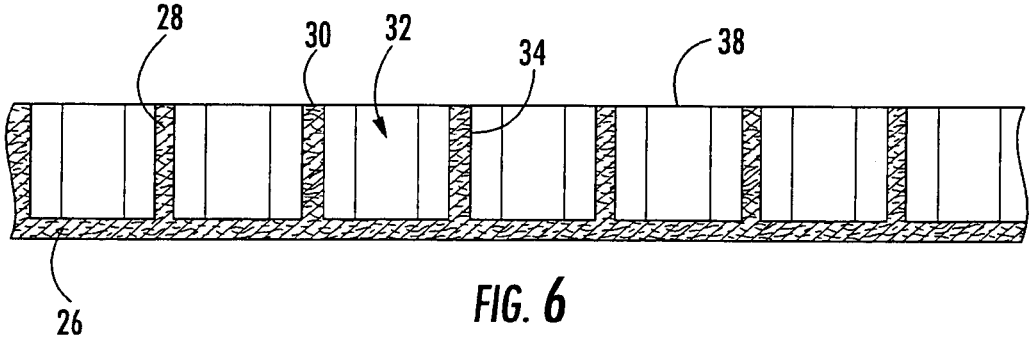
Figure 16:
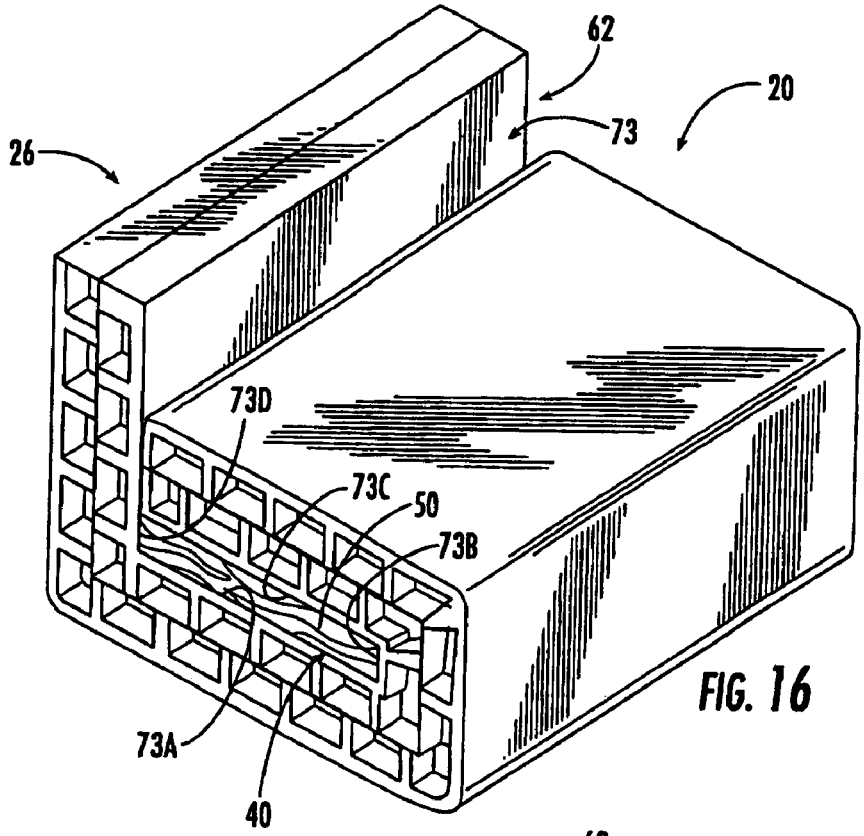
Figure 17:
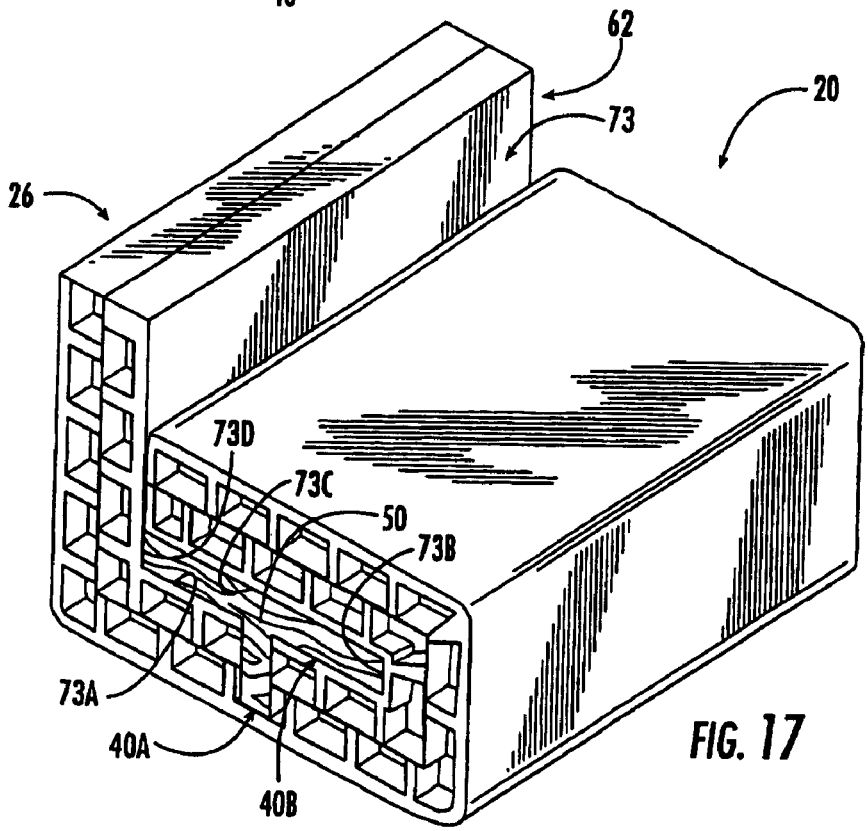

Having thus described the invention in general terms, reference will now be made to the accompanying drawings, which are not necessarily drawn to scale, and wherein:

FIG. 1 is a perspective view of a reinforced panel according to one embodiment of the present invention;

FIGS. 2A–2C illustrate various cross-sectional views of integral and contiguous cells according to the present invention;

FIGS. 3A–3I show various cross-sectional views of a reinforcing member according to the present invention;

FIG. 4 illustrates an alternative embodiment of a reinforced panel according to the present invention;

FIG. 5 illustrates yet another alternative embodiment of a reinforced panel according to the present invention;

FIGS. 6–10 illustrate selected steps for forming a reinforced panel according to one embodiment of the present invention;

FIGS. 11–15 illustrate selected steps of an alternative method of forming a reinforced panel according to the present invention;

FIG. 16 illustrates a perspective view of an alternative reinforced panel according to the present invention; and FIG. 17 illustrates an alternate arrangement of the panel shown in FIG. 16.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Turning now to the figures, FIGS. 1 and 2 show a reinforced support structure or panel 20 according to one embodiment of the present invention. The panel 20 is useful for supporting objects and transporting goods, although other uses and benefits are contemplated by the present invention. As shown, the panel 20 has opposing ends 21 and sidewalls 23. The thickness of the panel 20 is defined as H1, and is determined by the distance between a top or interior side 22 and a bottom or exterior side 24 of a face sheet 26. The face sheet 26 is preferably formed of fibrous materials, such as wood fibers described in U.S. Pat. No. 4,702,870 to Setterholm, et al., which is discussed above. Recycled fibrous materials may also be used, as well as plastics and composites. The interior side 22 and exterior side 24 of the face sheet 26 are generally planar and smooth, although it is possible to have a roughened surface on either or both of the sides. In one embodiment, a planar sheet 38 forms part of the panel 20 and defines an outer surface of the interior side 22. The panel 20 can also be impregnated with resin to render it water-resistant, if desired.

The panel 20 also includes a plurality of integral and intersecting ribs 28 that extend from the bottom end of the face sheet 26 and have a distal end 30 at the top side 22 of the panel. The ribs 28 have walls 34 that define contiguous cells 32 of open space. As shown in FIGS. 2A–2C, the cells 32 may have a variety of shapes and sizes. In particular, the cells 32 may have a polygonal shape such as hexagonal (FIG. 2A) or square (FIG. 2B), or round (FIG. 2C). The cells 32 provide stiffness to the panel 20 using a minimal amount of material. The exact shape and size of the cells 32 may be determined depending on the application and design choice, and other shapes and sizes are contemplated by the present invention.

The ribs 28 further define a channel 40 having a surface 42 that extends along the face sheet 26. Although the channel 40 is shown as extending along a path parallel to the sidewalls 23 of the panel 20, the channel 40 may extend along the line parallel to the ends 21, or at an angle to the sidewalls or ends, or a combination thereof. As shown in FIG. 1, the channel 40 is defined by the ribs 28 and extends between the top side 22 and bottom side 24 of the face sheet 26. In order to provide increased bending resistance of the panel 20, a reinforcing member 50 having a surface 52 is positioned within the channel 40 and secured thereto. Preferably, the channel 40 is sized to receive the reinforcing member 50 such that the surface 42 of the channel registers and forms a close-fitting relationship with the surface 52 of the reinforcing member. In one embodiment, the reinforcing member 50 is flush with the distal end 30 of the ribs 28, although in an alternative embodiment the reinforcing member may extend beyond the distal end of the ribs.

Figure 3A:
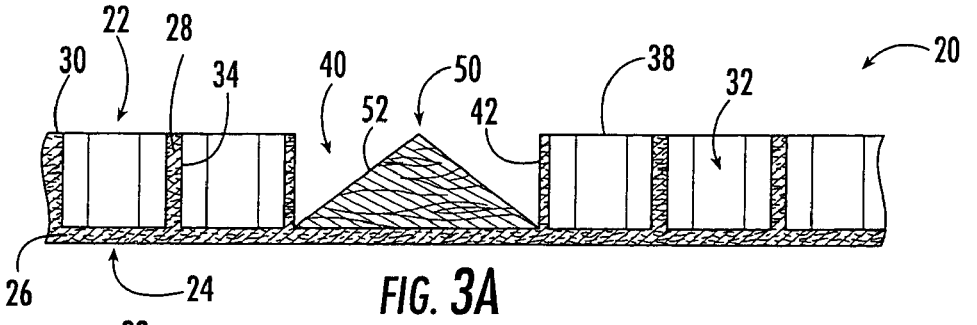
Figure 3B:
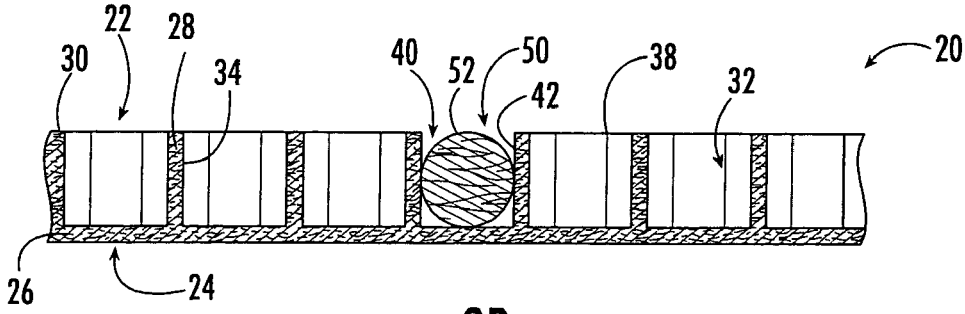
Figure 3C:
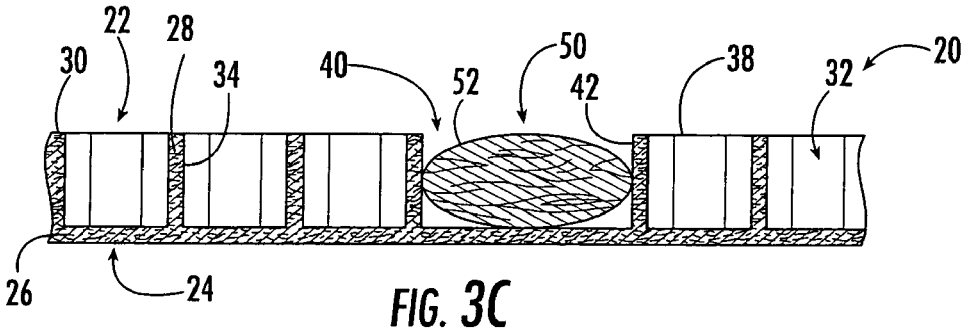
Figure 3D:
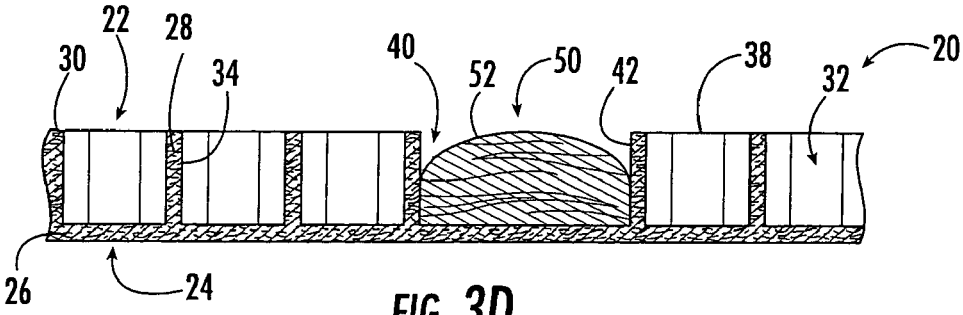
Figure 3E:
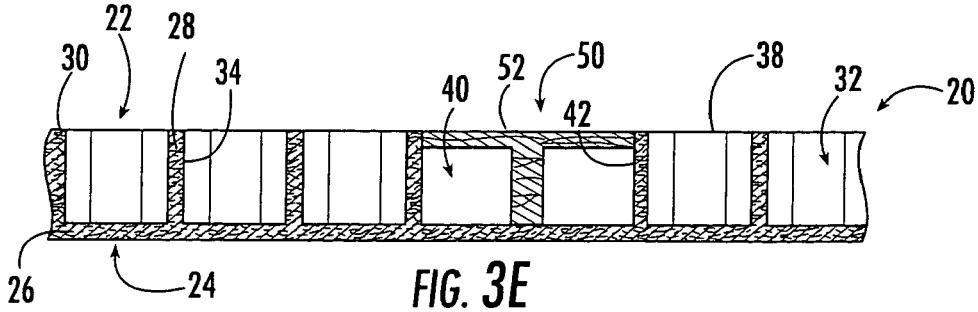
Figure 3F:
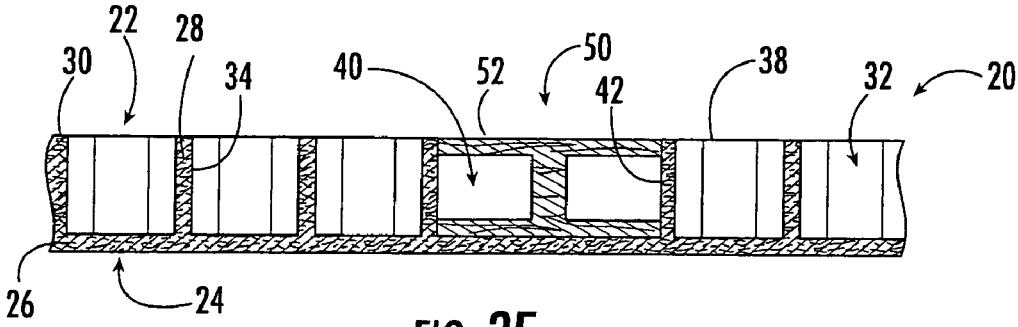
Figure 3G:
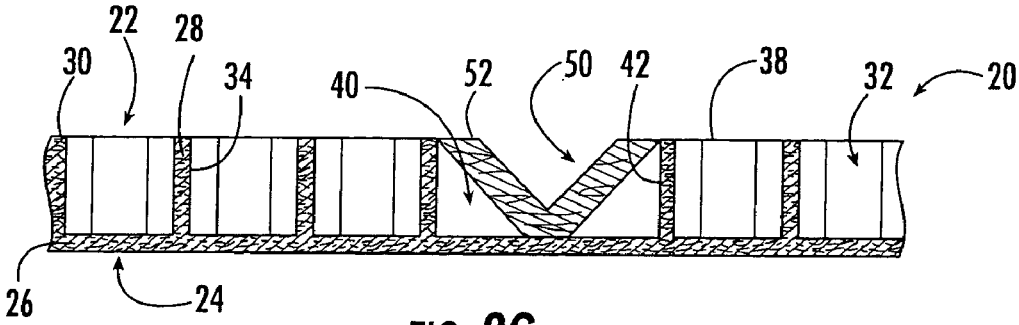
Figure 3H:
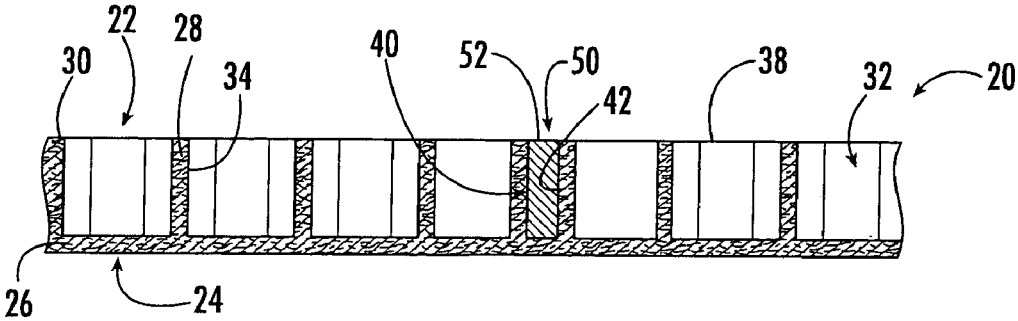
Figure 3I:
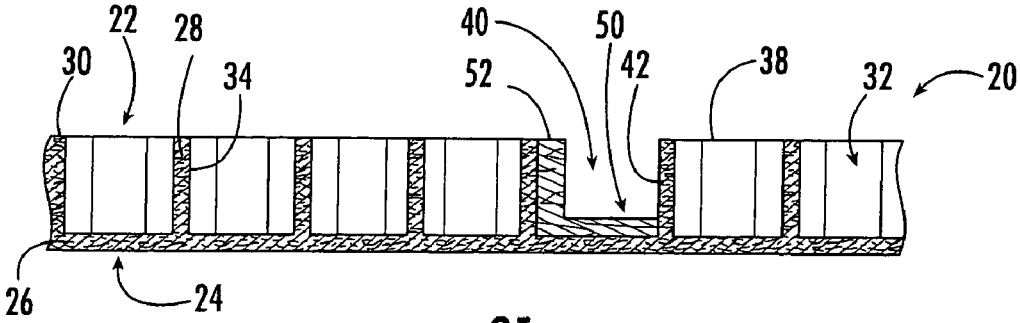

FIGS. 3A–3I illustrate various embodiments and designs of the reinforcing member 50. In particular, the cross-sectional shapes of the reinforcing member 50 include polygonal, such as a triangular shape (FIG. 3A), circular (FIG. 3B), oval (FIG. 3C), elliptical (FIG. 3D), T-shaped (FIG. 3E), I-shaped (FIG. 3F), V-shaped (FIG. 3G), ǀ-shaped (FIG. 3H), and L-shaped (FIG. 3I). The reinforcing member 50 preferably comprises a paperboard lamination formed from multiple plies of paperboard adhered together and then folded or arranged to form the desired cross-sectional shape. The plies of the reinforcing member 50 preferably are dry-bonded to each other using a modified silicate adhesive or the like. Such an adhesive and dry-bonding process adds little moisture to the panel 20. Other materials may also be used to form the reinforcing member 50, such as wood, plastic, metal, and combinations thereof. In one embodiment, the reinforcing member 50 is dry-bond laminated to the channel 40 so that the surfaces 42, 52 have a strong bond therebetween. Other ways of securing the reinforcing member 50 include using other types of adhesives, pressing the reinforcing member 50 into a snap-fit or frictional fit, or other type of arrangement.

FIG. 4 shows a perspective view of an alternative embodiment of the present invention, wherein a second face sheet 62 having a top end 63 and a bottom end 64 is placed on the face sheet 26 to form an overall thicker panel 20. The second face sheet 62 also includes a plurality of cells 72 formed by a plurality of integral and intersecting ribs 76 having walls 78 and distal ends 70 that define the size and shape of the cells 72. The face sheet 62 also has opposing ends 61 and sidewalls 65, and the thickness H2 of the face sheet is determined by the length of the ribs 76. The face sheet 62 may not define a channel, but may instead only provide additional structural support. However, FIG. 4 shows one embodiment where the face sheet 62 defines a channel 80 having a surface 84 that may have a size and shape as described above for the channel 40. A reinforcing member 90 having outer surface 92 is shown in the channel 90 and positioned adjacent the reinforcing member 50. More particularly, the reinforcing members 50, 90 are arranged such that they are aligned when the face sheets 26, 62 are placed together and bonded together to form a thicker panel 20.

FIG. 5 illustrates an alternative embodiment wherein the face sheet 26 defines a channel 40 that extends from the bottom end 24 to the top end 22, and the face sheet 62 defines a channel 80 that extends at least partially from the distal end 70 of the ribs 76 toward the top end 63. However, the channels 40, 80 are sized and arranged to accommodate only a single reinforcing member 50 that is shared between the two face sheets of the panel 20. More specifically, the reinforcing member 50 is positioned in the channels 40, 80 such that an upper edge 51 extends beyond the distal edge 30 of the ribs 28 and into the channel 80 defined by the face sheet 62. The reinforcing member 50 is secured to both face sheets 26, 62 and provides increased bending resistance of the panel 20, and also can assist with the registration and alignment of the face sheets.

FIGS. 16 and 17 illustrate alternative arrangements for the panel 20. As shown in FIG. 16, the panel 20 includes two face sheets 26, 62 that are bonded to one another as described above, yet neither face sheet defines a channel or includes a reinforcing member embedded therein. Instead, the face sheets 26, 62 are folded, molded, or otherwise manipulated so that a top surface 73 forms surfaces 73A–73D that define a channel 40. A reinforcing member 50 is positioned within the channel 40 and bonded thereto for providing increased bending resistance of the panel 20. Likewise, the folded portion of the panel 20 is bonded to the remainder of the panel to form a strong, load-bearing structure. FIG. 17 shows an alternative arrangement wherein the face sheets 26, 62 define a channel 40A that is in communication with a channel 40B formed by the wall 73 as shown in FIG. 16. In this embodiment, the reinforcing member 50 has a "T" shape, although the channels 40A, 40B and reinforcing member 50 can have various and complimentary shapes, such as those shapes described herein. The arrangements shown in FIGS. 16 and 17 and the process of forming these and other arrangements may be particularly advantageous when relating to runners of pallets and the like. The runners act as vertical risers or spacers on the bottom of the pallet and space the main supportive surface of the pallet from the ground. Advantageously, the reinforcing member 50 provides added stiffness to the runner to withstand bending and normal loads.

Figure 7:
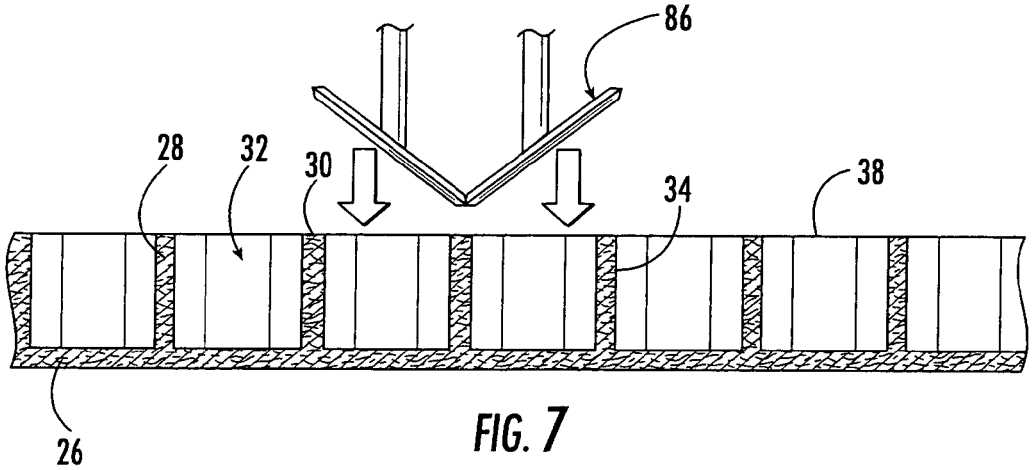
Figure 8:
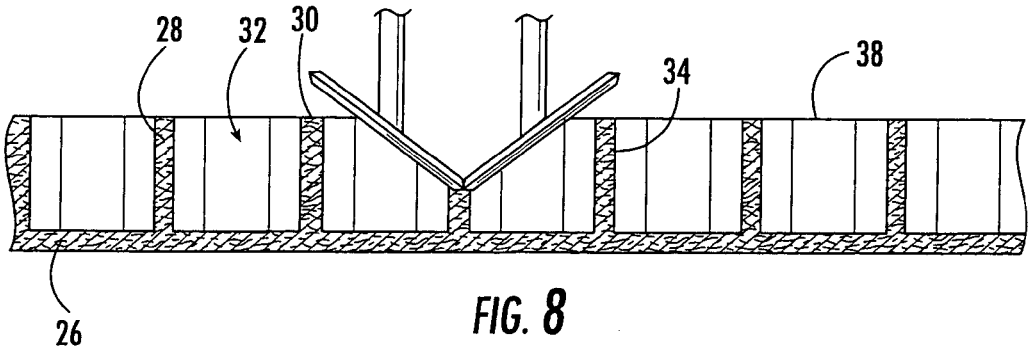
Figure 9:
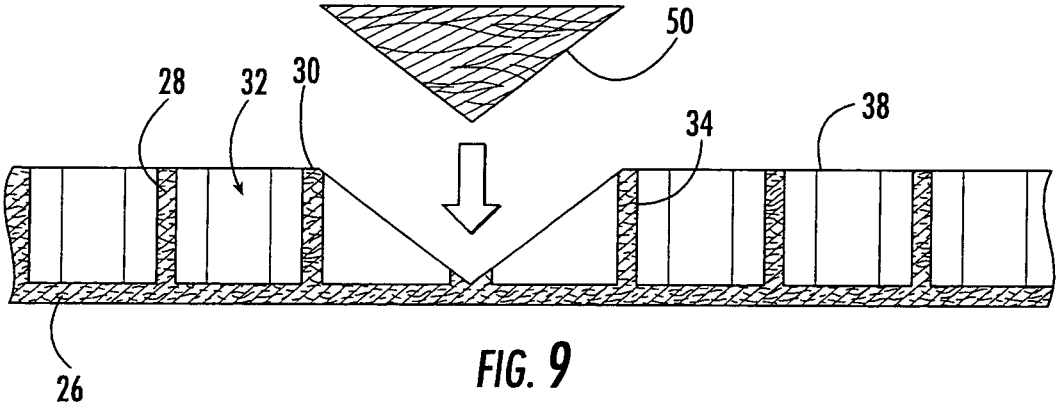
Figure 10:
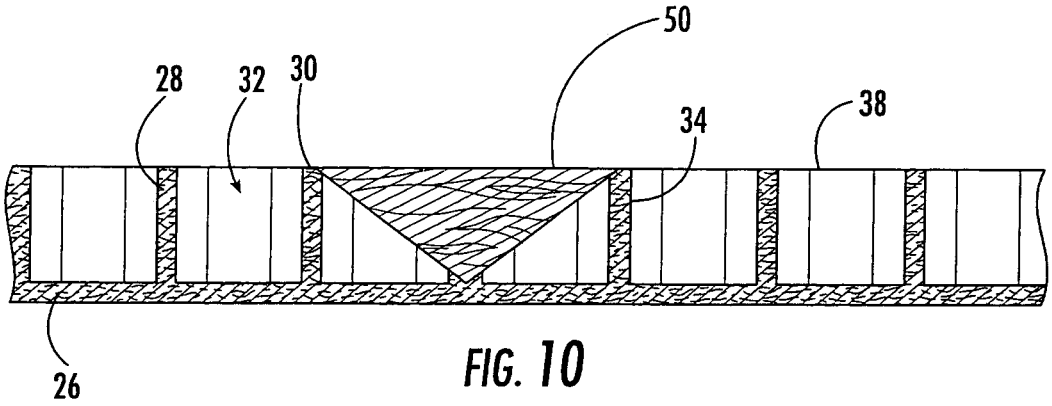
Figure 11:
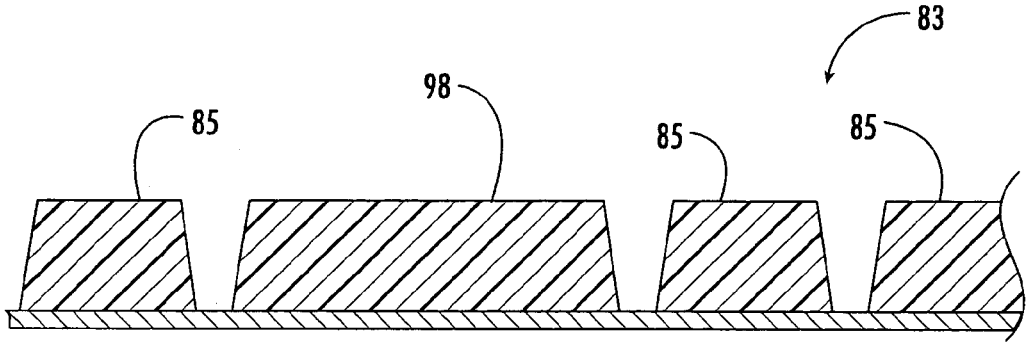

Methods of forming a panel according to the present invention are also provided and shown in FIGS. 6–15. In one method shown in FIGS. 6–10, a face sheet 26 is formed having a plurality of integral ribs 28 extending therefrom. As discussed above, the ribs 28 have distal ends 30 and form contiguous cells 32 having surfaces 34 in one or more of the shapes shown in FIG. 2. In order to form a channel in the panel 20, a cutting device 86, such as dual rotating cutting blades, a router, or the like, is brought into contact with the ribs 28 and top sheet 38, if present (FIG. 7). The cutting device 86 is lowered into the face sheet 26 so that a channel 40 is formed corresponding to the shape defined by the cutting device 86 (FIG. 8). A corresponding reinforcing member 50 is then placed inside the channel 40 and secured thereto (FIG. 9).

Figure 12:
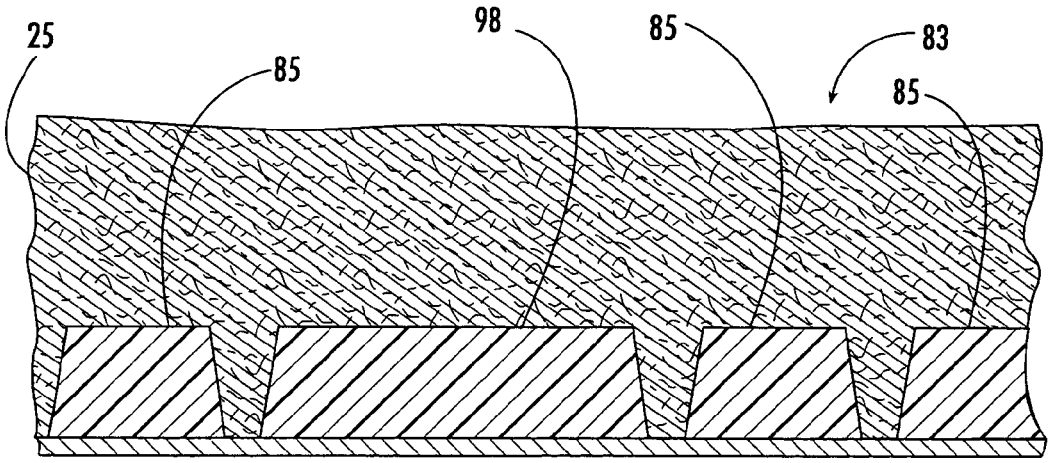
Figure 13:
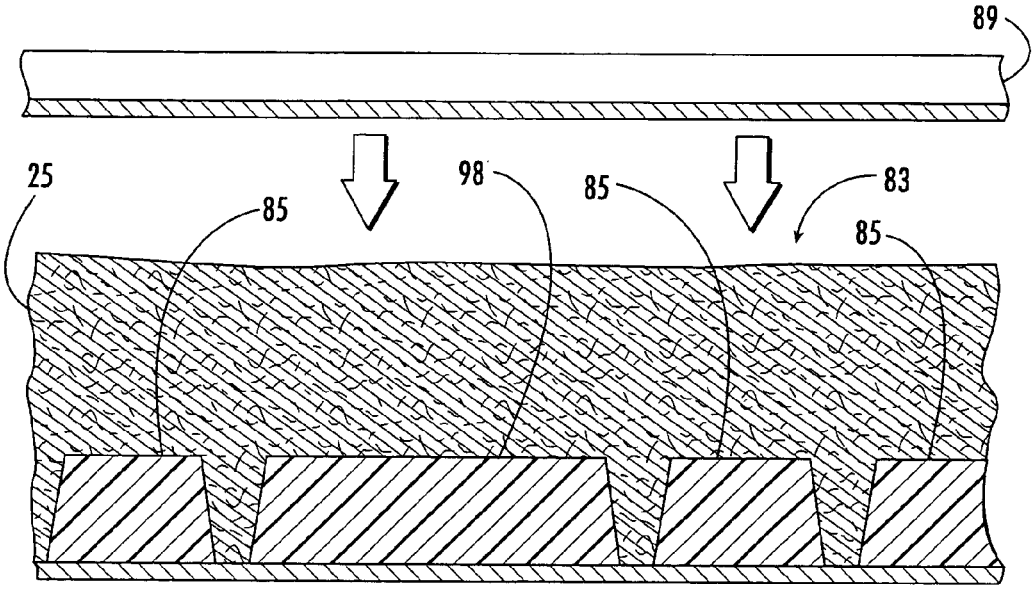
Figure 14:
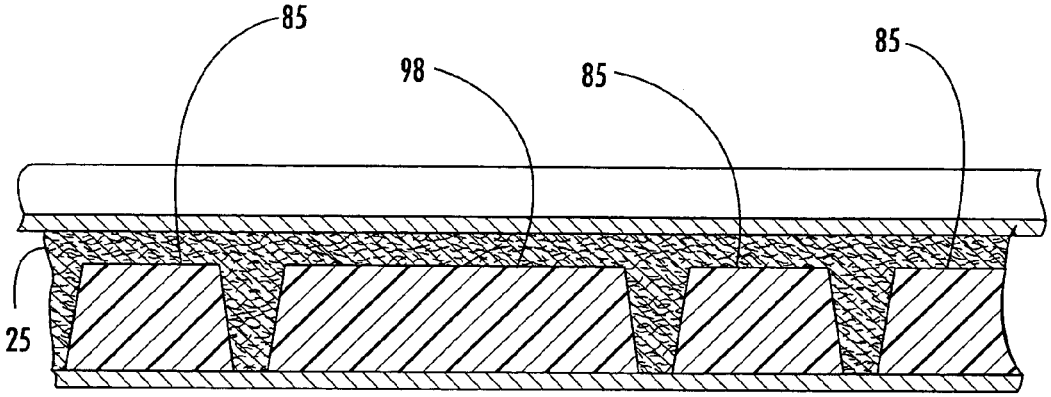
Figure 15:
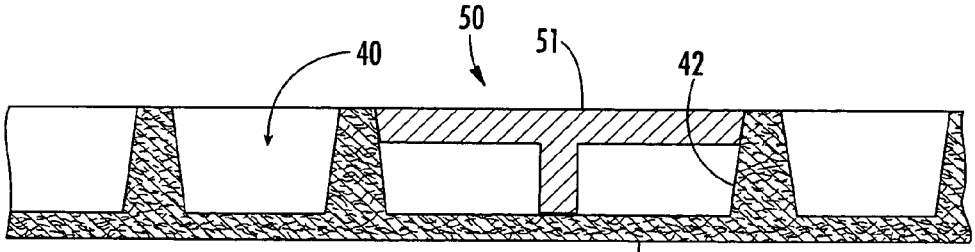

An alternative method for forming a panel 20 is shown in FIGS. 11–15 and includes utilizing a mold 83 having a plurality of mold inserts 85 distributed throughout, including a channel mold insert 98. FIG. 12 illustrates the deposition of previously prepared material, such as wood fibers 25, on to the mold inserts 85, 98. At this stage, the prepared wood fibers 25 are uniformly distributed over the mold surfaces, yet have very little structural integrity. FIG. 13 illustrates a forming step whereby a pressing device 89 is forced upon the wood fibers 25, which compress under the load exerted by the pressing member 89 and by the mold 83 and mold inserts 85, 98. Water is expressed from the slurry through drainage holes (not shown) in the mold 83, so that the panel 20 is densified. FIG. 14 illustrates the forces presented during the pressing step. Heat and possibly suction are provided during this step in order to form the face sheet 26. Finally, FIG. 15 illustrates the completed face sheet 26 defining a channel 40 with surface 42 that is formed by molding the channel during the formation of the face sheet. As discussed above, a corresponding reinforcing member 50 is then secured in the channel 40 as describe above to provide structural support and increased bending resistance of the panel 20.

Accordingly, the panel 20 of the present invention provides an improved and cost efficient structure that lasts longer, is environmentally conscious, and provides superior structural qualities compared to structures known in the art. The reinforcing member 50 can be one of many shapes, and in conjunction with the channel 40, the reinforcing member can be quickly and easily positioned in the panel, even retroactively, to provide immediate structural support and increased bending resistance of the panel. While certain shapes and arrangements have been shown in the figures and described therein, the present invention contemplates panels having reinforcing members of different shapes and sizes present in the panel. The reinforcing members may also have various positions and arrangements depending on the particular use and properties desired of the panel. In addition, the panels described herein may be used in a variety of applications, and are not limited to panels or pallets for transporting or supporting goods. Therefore, the present invention contemplates the panels described herein as being used in a broad range of structural and supportive applications.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A reinforced panel, comprising:

a face sheet having an interior side and an exterior side;

a plurality of ribs projecting from the interior side of the face sheet, the ribs intersecting to form contiguous cells spaced apart along length and width directions of the reinforced panel, the ribs and the face sheet comprising a one-piece molded fibrous panel such that the ribs are integral with the face sheet, the ribs having distal ends, the panel defining at least one channel extending across a plurality of contiguous cells; and an elongate reinforcing member positioned in the at least one channel and secured thereto for increasing bending resistance of the reinforced panel.

2. A panel according to claim 1, wherein the reinforcing member has a cross-sectional shape selected from the group consisting of polygonal, circular, oval, and elliptical.

3. A panel according to claim 1, wherein the reinforcing member has a cross-sectional shape selected from the group consisting of "T" shaped, "I" shaped, "V" shaped, "ſ" shaped, and "L" shaped.

4. A panel according to claim 3, wherein the reinforcing member has a top end that is flush with the distal ends of the ribs.

5. A panel according to claim 1, wherein the reinforcing member is secured to the channel by one of the group consisting of dry bond lamination, adhesive, snap-fit, and frictional fit.

6. A panel according to claim 1, wherein at least one of the contiguous cells has a cross-sectional shape selected from the group consisting of round, elliptical, oval, and polygonal.

7. A panel according to claim 1, wherein at least the face sheet, reinforcing member, and ribs are formed from papermaking fibers.

8. A panel according to claim 1, further comprising a planar sheet attached at least to the distal ends of the intersecting ribs.

9. A reinforced panel, comprising:

a first face sheet having an interior side and an exterior side;

a plurality of first ribs projecting from the interior side of the first face sheet, the first ribs intersecting to form contiguous cells spaced apart along length and width directions of the reinforced panel, the first ribs and the first face sheet comprising a one-piece molded fibrous first panel such that the first ribs are integral with the first face sheet, the first ribs having distal ends;

a second face sheet having an interior side and an exterior side;

a plurality of second ribs projecting from the interior side of the second face sheet, the second ribs intersecting to form contiguous cells spaced apart along length and width directions of the reinforced panel, the second ribs and the second face sheet comprising a one-piece molded fibrous second panel such that the second ribs are integral with the second face sheet, the second ribs having distal ends, at least one of the first and second panels defining at least one channel extending across a plurality of contiguous cells;

the first and second panels being positioned in overlying relation and joined together to form the reinforced panel; and at least one elongate reinforcing member positioned in the at least one channel and secured thereto for increasing bending resistance of the reinforced panel.

10. A panel according to claim 9, wherein the at least one reinforcing member has a cross-sectional shape selected from the group consisting of polygonal, circular, oval, and elliptical.

11. A panel according to claim 9, wherein the at least one reinforcing member has a cross-sectional shape selected from the group consisting of "T" shaped, "I" shaped, "V" shaped, "ſ" shaped, and "L" shaped.

12. A panel according to claim 11, wherein the first panel defines a first channel and the second panel defines a second channel, and wherein the at least one reinforcing member includes a first reinforcing member and a second reinforcing member, the first reinforcing member being positioned at least partially in the first channel, and the second reinforcing member being positioned at least partially in the second channel.

13. A panel according to claim 12, wherein the first reinforcing member has an end that is flush with the distal ends of the first ribs, and wherein the second reinforcing member has an end that is flush with the distal ends of the second ribs.

14. A panel according to claim 9, wherein the at least one reinforcing member is secured to the channel by one of the group consisting of dry bond lamination, adhesive, snap-fit, and frictional fit.

15. A panel according to claim 9, wherein at least one of the first ribs and second ribs forms at least one contiguous cell having a cross-sectional shape selected from the group consisting of round, elliptical, oval, and polygonal.

16. A panel according to claim 9, wherein at least one of the face sheets and at least one of the ribs are formed from paperboard material.

17. A panel according to claim 9, further comprising a planar sheet attached at least to the distal ends of the intersecting ribs.

18. A panel according to claim 12, wherein at least one of the first and second reinforcing members is made from at least one of the materials selected from the group consisting of paperboard, wood, metal, and plastic.

19. A method of forming a reinforced panel, comprising:

forming a first face sheet having a plurality of ribs extending therefrom, the ribs having distal ends and intersecting to form contiguous cells spaced apart along length and width directions of the reinforced panel, the ribs and the first face sheet comprising a one-piece molded fibrous first panel such that the ribs are integral with the first face sheet;

forming a first channel in the first panel that extends across a plurality of contiguous cells; and securing an elongate first reinforcing member in the first channel for increasing the bending resistance of the reinforced panel.

20. A method according to claim 19, wherein the channel forming step and the face sheet forming step occur concurrently.

21. A method according to claim 19, wherein the channel forming step includes cutting the first panel to define the first channel.

22. A method according to claim 19, wherein the channel forming step includes molding the first panel to define the first channel.

23. A method according to claim 19, wherein the securing step includes securing the first reinforcing member in the first channel by one of the group consisting of dry bond laminating, adhering with an adhesive, snapping in place, and pressing into a frictional fit.

24. A method according to claim 19, wherein the securing step includes securing the first reinforcing member in the first channel whereby a portion of the first reinforcing member extends beyond the distal ends of the integral ribs.

25. A method according to claim 19, wherein the securing step includes securing the first reinforcing member in the first channel whereby the first reinforcing member is flush with the distal ends of the integral ribs.

26. A method according to claim 19, further comprising:

forming a second face sheet having a plurality of ribs extending therefrom, the ribs having distal ends and intersecting to form contiguous cells, the ribs and the second face sheet comprising a one-piece molded fibrous second panel such that the ribs are integral with the second face sheet;

forming a second channel in the second panel that extends across a plurality of contiguous cells;

securing at least one of the first reinforcing member and a second reinforcing member in the second channel; and attaching the first panel to the second panel to form the reinforced panel.

27. A method according to claim 26, wherein the attaching step includes aligning and securing the distal ends of the ribs of the first panel and the distal ends of the ribs of the second panel to define at least one complete contiguous cell therebetween.

28. A method according to claim 26, wherein securing at least one of the first and second reinforcing members in the second channel includes securing the second reinforcing member in the second channel, and wherein the attaching step includes positioning the first and reinforcing members against one another.

29. A method according to claim 26, wherein securing at least one of the first and second reinforcing members in the second channel includes securing the first reinforcing member in the second channel.

30. A reinforced molded fibrous panel, comprising:

a molded fibrous face sheet having opposite generally planar surfaces and a plurality of fibrous ribs molded integrally with the face sheet and projecting from one of the generally planar surfaces thereof, the ribs intersecting one another to form a plurality of cells each extending in a thickness direction of the panel and spaced apart along length and width directions of the panel;

an elongate channel formed in the panel, the channel extending along a direction perpendicular to the thickness direction and spanning a plurality of contiguous ones of the cells; and an elongate reinforcing member secured in the channel.

31. The reinforced molded fibrous panel of claim 30, wherein the reinforcing member extends across an entire width of the panel.

* * * * *